United States Patent [19]

McAfee et al.

[11] 4,171,267

[45] Oct. 16, 1979

[54] ORGANOPOLYSILOXANE-HYDROCARBON OIL SOLUTIONS

[75] Inventors: Richard C. McAfee, Adrian; Jerold A. Craig, Jasper, both of Mich.

[73] Assignee: SWS Silicones Corporation, Adrian, Mich.

[21] Appl. No.: 955,834

[22] Filed: Oct. 30, 1978

[51] Int. Cl.[2] ..... D06M 13/10

[52] U.S. Cl. ..... 252/8.6; 8/115.6; 106/287.13; 252/49.6; 428/391

[58] Field of Search ..... 252/8.6, 32.7 E, 49.6; 8/115.6; 106/287.13, 287.16; 428/391

[56] References Cited

U.S. PATENT DOCUMENTS

| | | | |
|---|---|---|---|
| 3,423,235 | 1/1969 | Campbell | 252/8.6 X |
| 3,445,385 | 5/1969 | Vartanian | 252/8.8 R |
| 3,634,236 | 1/1972 | Buster et al. | 252/8.6 |
| 3,896,032 | 7/1975 | Stroh et al. | 252/8.6 |
| 3,929,492 | 12/1975 | Chapman et al. | 106/287.13 |
| 4,059,534 | 11/1977 | Morro et al. | 252/32.7 E |
| 4,115,343 | 9/1978 | Guillaume et al. | 252/49.6 |

*Primary Examiner*—William E. Schulz

[57] ABSTRACT

This invention relates to a composition containing (A) a bridging agent, (B) a hydrocarbon oil and (C) an organopolysiloxane fluid, in which the organopolysiloxane fluid (C) is immiscible with hydrocarbon oil (B) in the absence of bridging agent (A) and a process for treating organic fibers therewith. The bridging agent is obtained from the reaction of a hydrolyzate of a diorganodihalosilane with a primary, secondary or tertiary alcohol, in which the hydrocarbon group of the alcohol is a saturated or unsaturated branched chain or an unsaturated linear chain and contains from 12 to 28 carbon atoms.

24 Claims, No Drawings

ORGANOPOLYSILOXANE-HYDROCARBON OIL SOLUTIONS

The present invention relates to organopolysiloxane-hydrocarbon oil solutions and more particularly to organopolysiloxane-hydrocarbon oil solutions which may be used as lubricants for organic fibers.

BACKGROUND OF INVENTION

Compositions containing organopolysiloxane polymers and hydrocarbon oils are known in the art. For example homogeneous mixtures containing from 1 to 50 percent by weight of polydimethylsiloxane having a viscosity at 100° F. of from 100,000 cs to 1,000,000 cs and the remainder of the mixture being a hydrocarbon oil are described in U.S. Pat. No. 4,059,534 to Morro et al. Also U.S. Pat. No. 4,115,343 to Guillaume et al describe homogeneous dispersions containing organopolysiloxane polymers, mineral oils and solid ethylene/-vinyl acetate copolymers.

Due to the inherent immiscibility of the dimethylpolysiloxane fluids with hydrocarbon oil, the compositions form two phases after standing for a short period of time. To overcome the problem of phase separation, various additives, generally in the nature of emulsifiers, have been employed which are effective for the intended purpose but characteristically increase the foaming tendencies of the hydrocarbon oil component. Another approach is described in U.S. Pat. No. 3,445,385, which discloses the use of organic ammonium complexes of clays of the montmorillonite group as dispersing agents. However, the solubility of these organophilic organo-ammonium bentonite dispersions still falls short of that desired, especially the storage stability required for long periods.

Thus a composition in which the hydrocarbon oil is miscible with the organopolysiloxane would provide certain advantages. For example, the composition remains stable, i.e., no phase separation. Also, the composition need not be agitated just prior to and during use. Moreover, a more uniform coating is achieved when the composition is in the form of a solution rather than as a mixture.

Therefore, it is an object of this invention to provide an organopolysiloxane-hydrocarbon oil composition. Another object of this invention is to provide a miscible composition containing an organopolysiloxane fluid and a hydrocarbon oil. Still another object of this invention is to provide a miscible composition containing an organopolysiloxane fluid and a hydrocarbon oil having improved storage stability. A further object of this invention is to provide a process for preparing a miscible composition containing an organopolysiloxane fluid and a hydrocarbon oil. A still further object of this invention is to provide a miscible composition containing an organopolysiloxane fluid and a hydrocarbon oil which may be applied to organic fibers to improve their lubricating properties.

SUMMARY OF INVENTION

The foregoing objects and others which will become apparent from the following description are accomplished in accordance with this invention, generally speaking, by providing a composition containing (A) a bridging agent, (B) a hydrocarbon oil and (C) an organopolysiloxane fluid, in which the organopolysiloxane (C) is immiscible with hydrocarbon oil (B) in the absence of bridging agent (A). The bridging agent is obtained from the reaction of (1) an organopolysiloxane selected from the group consisting of (i) hydroxyl-terminated organopolysiloxanes, (ii) cyclic siloxanes and (iii) mixtures thereof, in which at least 80 percent of the organic groups are methyl radicals with (2) an alcohol having from 12 to 28 carbon atoms, in which the hydrocarbon group is a saturated or unsaturated branched chain or an unsaturated linear chain.

DETAILED DESCRIPTION OF INVENTION

Alcohols which may be reacted with the organopolysiloxanes (1) may be represented by the general formula $$ROH$$

in which R is a saturated or unsaturated branched chain hydrocarbon radical or unsaturated linear hydrocarbon radical having from 12 to 28 carbon atoms.

Examples of suitable alcohols represented by the above formula are isohexacosanol, isoeicosanol, isohexadecanol, 2-butyl-octanol-1, 2-hexyl-decanol-1, 2-octyl-dodecanol-1, 2-butyl-decanol-1, 6-butyl-octanol-2, 4-butyl-2-methyl-decanol-2, 8-hexyldecanol-1, octadecenol, 3,7-dimethyl-1, 6-octadien-3-ol, 2-dedecyl-hexadecanol-1 and the like.

Organopolysiloxanes (1) which are reacted with the alcohol to form the bridging agent may be represented by the general formula $$HO\ Si\ R'_2\ (Si\ R'_2O)_n\ Si\ R'_2\ OH$$

wherein the R' radical, which may be the same or different, represent monovalent hydrocarbons radicals or substituted monovalent hydrocarbon radicals and n is a number having a value of at least 1. Examples of suitable monovalent hydrocarbon radicals are alkyl radicals having from 1 to 18 carbon atoms such as methyl, ethyl, propyl, butyl, hexyl, octyl, decyl and octadecyl radicals; cycloalkyl radicals such as the cyclohexyl radical; aryl radicals such as the phenyl radical; alkaryl radicals such as the tolyl radical and aralkyl radicals such as the benzyl radical. The substituted monovalent hydrocarbon radicals represented by R' are halogenated hydrocarbon radicals or cyanoalkyl radicals such as 3,3,3-trifluoropropylradical, chlorophenyl radicals or the beta-cyanoethyl radical. In the above formula it is preferred that at least 80 percent of the number of R' radicals be methyl radicals.

The value of n may range from 1 to about 500 and more preferably from about 10 to about 100. Although this is not always indicated in formulas of this type, there can be within or along the siloxane chain in the above formula, siloxane units other than diorganosiloxane units in amounts up to about 10 mol percent. Generally they are present only as impurities. The lower limit of the ratio of R' radicals to Si atoms is preferably 1.9, whereas the upper limit in the ratio of R' radicals to Si atoms is preferably 2.25.

The organopolysiloxanes can be either homo- or co-polymers. Examples of preferred organopolysiloxanes are hydroxyl-terminated dimethylpolysiloxanes and hydroxyl-terminated copolymers containing dimethylsiloxane and methylphenylsiloxane and/or phenylsiloxane units. Although it is preferred that these hydroxyl-terminated organopolysiloxanes have a viscosity of from about 10 to 1,000 cs at 25° C., they may have a viscosity as high as 10,000 cs at 25° C.

Organopolysiloxanes other than those corresponding to the above formula may be reacted with the alcohol to form the bridging agent of this invention. These organopolysiloxanes may be represented by the general formula $$(R'_2SiO)_m$$

in which R' is the same as above and m is a number of from 3 to 8.

Examples of suitable organopolysiloxanes are cyclic siloxanes such as hexamethylcyclotrisiloxane, octamethylcyclotetrasiloxane, octabutylcyclotetrasiloxane, octahexylcyclotetrasiloxane, decamethylcyclopentasiloxane, dodecamethylcyclohexasiloxane, 1,2,3-trimethyl-1,2,3-triphenylcyclotrisiloxane and 1,2,3,4-tetramethyl-1,2,3,4-tetraphenylcyclotetrasiloxane.

Also the bridging agent may be prepared by reacting a mixture of organopolysiloxanes containing hydroxyl-terminated organopolysiloxanes and cyclic siloxanes with an alcohol.

In a preferred embodiment of this invention, the bridging agent may be prepared by reacting a product obtained from the hydrolysis of diorganodihalosilanes with the alcohol. The silanes may be hydrolyzed in accordance with the procedure described in U.S. Pat. Nos. 2,452,416; 2,426,912 to Wright; 2,448,756 to Agens and 2,758,124 to Schwenker. Generally the product obtained from the hydrolysis reaction contains hydroxyl-terminated organopolysiloxanes and cyclic siloxanes, preferably in a 50:50 weight ratio of hydroxyl-terminated organopolysiloxanes and the cyclic siloxanes.

The amount of alcohol employed in the reaction with the organopolysiloxane (1) is not critical and may range from about 2 to 50 percent by weight and more preferably from 5 to 30 percent by weight based on the weight of the alcohol and the organopolysiloxane (1). Likewise when a hydrolyzate is employed in lieu of either the hydroxyl-terminated organopolysiloxane or cyclic siloxane, the amount of alcohol may range from 2 to 50 percent by weight and more preferably from 5 to 30 percent by weight based on the weight of the hydrolyzate and alcohol.

In preparing the bridging agent of this invention, the organopolysiloxane (1) or hydrolyzate is reacted with the alcohol in the presence of an acid or basic catalyst. Although, the temperature is not critical, it is preferred that the reaction be conducted at a temperature of from 50° to 250° C., preferably from 100° to 200° C. It is preferred that the water be removed as formed.

Although the reaction time is not critical, it is preferred that it range from about 1 to 10 hours or more, and more preferably from 1.5 to 5 hours. The reaction may be conducted at atmospheric, subatmospheric or superatmospheric pressures.

At the completion of the reaction, the reaction product is distilled preferably at reduced pressure to remove the volatile materials.

Catalysts which may be employed in the preparation of the bridging agent are acid catalysts, such as acid clays and organic and inorganic acids. Suitable catalysts are benzenesulfonic acid, para-toluenesulfonic acid, sulfuric acid, sulfurous acid, nitric acid, perchloric acid, hydrochloric acid and acid clays such as Filtrol No. 13 and No. 24 (available from Filtrol Corporation).

Basic catalysts which may be employed are alkali metal hydroxides, such as potassium hydroxide, sodium hydroxide, lithium hydroxide and the quaternary ammonium bases such as the hydroxides, silanolates or siloxanolates. Other basic catalysts which may be employed are alkali metal hydrides, e.g., sodium hydride, potassium hydride, lithium hydride; alkali metal alkyls, e.g., ethyllithium, ethylsodium, butyllithium and alkali metal aryls, e.g., phenyllithium and the like.

Although the amount of catalyst is not critical, it is preferred that from about 0.002 up to about 10 percent by weight of catalyst based on the total weight of the reactants, i.e., organopolysiloxane and alcohol, be employed in the reaction to form the bridging agent. Greater amounts of catalyst may be used; however amounts above about 10 percent by weight do not substantially alter the reaction rate.

The bridging agent is incorporated in a mixture containing (B) a hydrocarbon oil and (C) an organopolysiloxane to form a miscible composition.

Organopolysiloxanes (C) which are mixed with hydrocarbon oils (B) may be represented by the general formula $$R' Si(R')_2O (R'_2SiO)_x (R')_2SiR'$$

wherein the R' radicals, which may be the same or different, represent monovalent hydrocarbon radicals or substituted monovalent hydrocarbon radicals and x is a number having a value of at least 50. Examples of suitable monovalent hydrocarbon radicals are alkyl radicals having from 1 to 18 carbon atoms such as for example, methyl, ethyl, propyl, butyl, hexyl, octyl, decyl, octadecyl radicals; cycloalkyl radicals such as the cyclohexyl radical; aryl radicals such as the phenyl radical; alkaryl radicals such as the tolyl radical and aralkyl radicals such as the benzyl radical. The substituted monovalent hydrocarbon radicals represented by R' are halogenated hydrocarbon radicals or cyanoalkyl radicals such as the 3,3,3-trifluoropropyl radical, chlorophenyl radicals or the beta-cyanoethyl radical. In the above formula, it is preferred that at least 80 percent of the number of R' radicals be methyl radicals.

The value of x is not critical and may range from 50 to about 100,000 and more preferably from about 1,000 to about 60,000. Although this is not always indicated in formulas of this type, there can be within or along the siloxane chain in the above formula siloxane units other than diorganosiloxane units in amounts up to about 10 mol percent. Generally they are present only as impurities. The lower limit of the ratio of R' radicals to Si atoms is preferably 1.9, whereas the upper limit in the ratio of R' radicals to Si atoms is preferably 2.25.

The organopolysiloxanes employed in the process of this invention can be either homo- or co-polymers.

Examples of preferred organopolysiloxanes (C) are triorganosiloxy-terminated organopolysiloxanes such as trimethylsiloxy-terminated dimethylpolysiloxane and copolymers containing dimethylsiloxane and methylphenylsiloxane or diphenylsiloxane units.

Preferably the organopolysiloxanes (C) have a viscosity of from about 50 to 400,000 cs at 25° C. and more preferably from about 100 to 100,000 cs at 25° C.

Blends of organopolysiloxanes having varying viscosities may also be used in this invention to form lubricating compositions.

The hydrocarbon oils (B) employed in the composition of this invention may be either synthetic or natural in origin. These oils, often referred to as mineral oils, can be obtained from petroleum, coal, gas and shale. These mineral oils may be further defined as being paraffin oils, naphthene oils and aromatic oils. Generally, these mineral oils are derived from petroleum and are of the lubricating oil viscosity range.

Other hydrocarbon oils which may be employed in the lubricating compositions of this invention are the synthetic lubricants which are obtained from the polymerization of alphaolefins. These synthetic lubricants are available, for example from Gulf Oil Chemicals Company, as GULF SYNFLUID$^R$ lubricants.

The hydrocarbon oils used in this invention preferably has a viscosity less than 40,000 cs at −65° F. and a flash point higher than 175° F.

The hydrocarbon oils can be employed alone or they can contain one or more additives. These additives are well known and improve the physical and rheological properties of these oils. Thus, for example, one or more of the following types of conventional additives may be employed, such as antioxidants, detergents, antirust agents, antisludge agents, viscosity index improvers, pour point depressants, extreme pressure agents and the like.

The organopolysiloxane (C) comprises the major portion of the lubricating composition and is used in an amount of from 60 to 98 percent by weight and more preferably from 70 to 95 percent by weight based on the weight of the organopolysiloxane (C) and the hydrocarbon oil (B).

The amount of bridging agent incorporated in the composition may range from 2 to 30 percent by weight and more preferably from 5 to 25 percent by weight based on the weight of the hydrocarbon oil (B), organopolysiloxane (C) and the bridging agent (A).

In preparing the lubricating composition of this invention, the bridging agent (A), hydrocarbon oil (B) and organopolysiloxane (C) may be mixed in any order. However, it is preferred that the bridging agent (A) be mixed with the hydrocarbon oil (B) prior to the addition of the organopolysiloxane (C).

In order to combine easy applicability with particularly good lubricating properties, it is preferred that the lubricating compositions employed in this invention have a viscosity below about 1,000 cs at 25° C. and more preferably from about 100 to 600 cs at 25° C.

The lubricating compositions of this invention are preferably used in the absence of a solvent, but if desired, they can be employed in an organic solvent such as aliphatic and aromatic hydrocarbon solvents, e.g., n-hexane, octane, benzene, toluene, xylene, or in organic solvents such as ethers, e.g., di-n-butylether and halogenated hydrocarbon solvents.

The lubricating compositions may be applied to organic fibers in the form of threads or yarns. The fibers may also be in the form of rovings, fleeces, mats or cloth. These compositions can be applied to organic fibers made of any material, such as wool, cotton, rayon, hemp, natural silk, polypropylene, polyester, polyurethane, polyamide, polyethylene, cellulose acetate and polyacrylonitrile or mixtures thereof.

The compositions of this invention may be applied to the fibers by any conventional technique known in the art, such as by spraying, immersion or by passing the fibers across a base which has been soaked with the lubricating composition.

In addition to the treatment of organic fibers to impart lubricity properties thereto, the compositions of this invention may also be used as antifoam agents in motor oils, as hydraulic fluids, transmission fluids and as greases.

The embodiments of this invention are further illustrated in the following examples in which all parts are by weight unless otherwise specified.

PREPARATION OF BRIDGING AGENT

EXAMPLE 1

To a 500 ml. flask equipped with a Dean-Stark trap, condenser, thermometer, stirrer and nitrogen sweep are added 100 parts of a hydroxyl-terminated dimethylpolysiloxane having a viscosity of 50 cs at 25° C., 13 parts of isostearyl alcohol and 2 parts of Filtrol No. 13 acid clay (available from Filtrol Corporation) and heated to 120° C. and maintained at this temperature for two hours. The reaction product is then cooled to 25° C., filtered and then heated to 175° C. for 2 hours under reduced pressure to remove the volatile materials. The product is cooled to about 90° C., then mixed with 1 part of activated charcoal, cooled to 25° C. and then filtered.

EXAMPLE 2

To a 500 ml. flask equipped with a Dean-Stark trap, condenser, thermometer, stirrer and nitrogen sweep, are added 100 parts of neutralized hydrolyzate having a viscosity of 20 cs at 25° C. and containing about 50 percent by weight of hydroxyl-terminated dimethylpolysiloxanes and 50 percent by weight of cyclic siloxanes (available from SWS Silicones Corporation as SWS-03355), 13 parts of isostearyl alcohol and 2 parts of Filtrol No. 13 acid clay (available from Filtrol Corporation). This mixture is heated to 120° C. and held there for 2.5 hours while removing the water of condensation. The reactants are cooled, filtered and distilled under reduced pressure (4.5 torr) at a temperature of 200° C. for 2 hours. The non-volatile product is cooled to 100° C. and mixed with 1 part of activated charcoal and then filtered. The resultant product has a viscosity of 74.1 cs at 25° C.

EXAMPLE 3

The procedure of Example 1 is repeated except that 100 parts of octamethylcyclotetrasiloxane is substituted for the hydroxyl-terminated dimethylpolysiloxane.

PREPARATION OF LUBRICATING COMPOSITION

EXAMPLES 4 TO 15

Lubricating compositions are prepared by mixing trimethylsiloxy-terminated dimethylpolysiloxanes with a bridging agent described above and mineral oil. The properties of the compositions are illustrated in the table following Example 18.

EXAMPLE 16

A bridging agent is prepared in accordance with the procedure of Example 2, except that 2-dodecyl-hexadecanol-1 is substituted for the isostearyl alcohol. This bridging agent is then substituted for the bridging agent in the composition of Example 4. A solution is obtained which does not separate after standing for at least three (3) months.

EXAMPLE 17

A bridging agent is prepared in accordance with the procedure of Example 2, except that octadecenol is substituted for the isostearyl alcohol. This bridging agent is substituted for the bridging agent in the composition of Example 4. A solution is obtained which does not separate after standing for at least three (3) months.

EXAMPLE 18

A polyethyleneglycol-terephthalic acid ester yarn is treated with the compositions of this invention by passing the yarn through a bath containing the composition of Example 4. The amount of lubricant absorbed by the yarn is approximately 2 percent of the yarn's weight. The treated yarns are evaluated by sewing tests at maximum sewing speed (7000 stitches/minute), on four layers of blue cotton twill. The thread tension is essentially constant, whereas when the yarn is treated with a dimethylpolysiloxane-hydrocarbon oil mixture, the thread tension varies considerably.

It is not intended to limit the invention solely to the specific examples described above, but to include all the variations and modifications falling within the scope of the appended claims.

TABLE

| Example No. | Siloxane Blend Parts | Siloxane Blend Viscosity cs at 25° C. | Siloxane Blend Parts | Siloxane Blend Viscosity cs at 25° C. | Bridging Agent Parts | Bridging Agent Example No. | Mineral Oil Parts | Mineral Oil Viscosity * | Product Viscosity cs at 25° C. |
|---|---|---|---|---|---|---|---|---|---|
| 4 | 26 | 50 | 59 | 1,000 | 10 | 1 | 5 | 45.2 | 391 |
| 5 | 35 | 50 | 35 | 5,000 | 20 | 1 | 10 | 45.2 | 435 |
| 6 | 42 | 50 | 28 | 5,000 | 20 | 1 | 10 | 45.2 | 319 |
| 7 | 35 | 50 | 20 | 60,000 | 30 | 2 | 15 | 27.4 | 456 |
| 8 | 40 | 50 | 15 | 60,000 | 30 | 2 | 15 | 27.4 | 337 |
| 9 | 208 | 50 | 472 | 1,000 | 80 | 3 | 40 | 45.2 | 379 |
| 10 | 336 | 50 | 224 | 5,000 | 80 | 2 | 80 | 45.2 | 324 |
| 11 | 320 | 50 | 120 | 60,000 | 240 | 3 | 12 | 27.4 | 349 |
| 12 | 80 | 50 | — | — | 10 | 2 | 5 | 45.2 | 56 |
| 13 | — | — | 80 | 10,000 | 10 | 2 | 5 | 45.2 | 9,000 |
| 14 | 26 | 50 | 59 | 1,000 | — | — | 5 | 45.2 | ** |
| 15 | 35 | 50 | 20 | 60,000 | — | — | 15 | 27.4 | ** |

*Kinematic, Centistokes (37.8° C.)
**Separates into two phases
Except for Examples 14 and 15, the lubricating compositions shown above did not separate into two phases after standing for three (3) months.

What is claimed is:

1. A composition containing (A) a bridging agent, (B) a hydrocarbon oil and (C) an organopolysiloxane fluid, in which the organopolysiloxane (C) is immiscible with hydrocarbon oil (B) in the absence of bridging agent (A), said bridging agent is obtained from the reaction of (1) an organopolysiloxane selected from the group consisting of (i) a hydroxyl-terminated organopolysiloxane, (ii) a cyclic siloxane having from 3 to 8 silicon atoms and (iii) mixtures thereof in which at least 80 percent of the organic groups are methyl radicals, with (2) an alcohol having from 12 to 28 carbon atoms which is selected from the group consisting of branched chain saturated and unsaturated alcohols and unsaturated linear alcohols.

2. The composition of claim 1, wherein the organopolysiloxane (C) is present in a major amount.

3. The composition of claim 1, wherein the organopolysiloxane (C) is pesent in an amount of from 60 to 98 percent by weight based on the weight of the organopolysiloxane (C) and hydrocarbon oil (B).

4. The composition of claim 1, wherein the bridging agent (A) is present in an amount of from 2 to 30 percent by weight based on the weight of the bridging agent (A), hydrocarbon oil (B) and organopolysiloxane (C).

5. The composition of claim 1, wherein the organopolysiloxane (C) has a viscosity of from 100 to 100,000 cs at 25° C.

6. The composition of claim 1, wherein the organopolysiloxane is represented by the formula $$R' \, Si \, R'_2O \, (Si \, R'_2O)_x \, R'_2Si \, R'$$

in which R' is selected from the group consisting of monovalent hydrocarbon radicals, halogenated monovalent hydrocarbon radicals and cyanoalkyl radicals and at least 80 percent of the R' radicals are methyl radicals and x is a number of at least 50.

7. The composition of claim 6, wherein R' is an alkyl radical having from 1 to 18 carbon atoms.

8. The composition of claim 1, wherein the alcohol is represented by the formula $$ROH$$

in which R is a hydrocarbon radical having from 12 to 28 carbon atoms and is selected from the group consisting of branched chain saturated and unsaturated hydrocarbon radicals and unsaturated linear hydrocarbon radicals.

9. The composition of claim 1, wherein the bridging agent is obtained from the reaction of a hydroxyl-terminated organopolysiloxane and an alcohol having from 12 and 28 carbon atoms which is selected from branched chain saturated and unsaturated alcohols and unsaturated linear alcohols.

10. The composition of claim 9, wherein the hydroxyl-terminated organopolysiloxane is represented by the formula $$HO \, SiR'_2O \, (SiR'_2O)_n \, R'_2 \, Si \, OH$$

in which R' is selected from the group consisting of monovalent hydrocarbon radicals, halogenated monovalent hydrocarbon radicals and cyanoalkyl radicals and at least 80 percent of the R' radicals are methyl radicals and n is from 1 to 500.

11. The composition of claim 1, wherein the organopolysiloxane (C) is a blend of at least two organopolysiloxane fluids having different viscosities.

12. A bridging agent which is obtained from the reaction of (1) an organopolysiloxane selected from the group consisting of (i) a hydroxyl-terminated organopolysiloxane, (ii) a cyclic siloxane and (iii) mixtures thereof in which at least 80 percent of the organic groups are methyl radicals with an alcohol having from 12 to 28 carbon atoms which is selected from the group consisting of branched chain saturated and unsaturated alcohols and unsaturated linear alcohols.

13. The bridging agent of claim 12, wherein the alcohol is represented by the formula

ROH in which R is a hydrocarbon radical having from 12 to 28 carbon atoms and is selected from the group consisting of branched chain saturated and unsaturated hydrocarbon radicals and unsaturated linear hydrocarbon radicals.

14. The bridging agent of claim 12, wherein the organopolysiloxane (1) is a neutralized hydrolyzate containing hydroxyl-terminated organopolysiloxanes and cyclic siloxanes.

15. The bridging agent of claim 12, wherein the organopolysiloxane (1) is reacted with the alcohol (2) at a temperature of from 50° to 250° C.

16. The bridging agent of claim 14, wherein the neutralized hydrolyzate contains hydroxyl-terminated dimethylpolysiloxanes and cyclic siloxanes in a weight ratio of about 50:50.

17. A process for improving the lubricating properties of organic fibers which comprises coating organic fibers with a composition containing (A) a bridging agent, (B) a hydrocarbon oil and (C) an organopolysiloxane fluid, in which the organopolysiloxane (C) is immiscible with hydrocarbon oil (B) in the absence of bridging agent (A), said bridging agent is obtained from the reaction of (1) an organopolysiloxane selected from the group consisting of (i) a hydroxyl-terminated organopolysiloxane, (ii) a cyclic siloxane having from 3 to 8 silicon atoms and (iii) mixtures thereof in which at least 80 percent of the organic groups are methyl radicals, with (2) an alcohol having from 12 to 28 carbon atoms which is selected from the group consisting of branched chain saturated and unsaturated alcohols and unsaturated linear alcohols.

18. The process of claim 17, wherein the organopolysiloxane (C) is present in a major amount.

19. The process of claim 17, wherein the organopolysiloxane (C) is present in an amount of from 60 to 98 percent by weight based on the weight of the organopolysiloxane (C) and hydrocarbon oil (B).

20. The process of claim 17, wherein the bridging agent (A) is present in an amount of from 2 to 30 percent by weight based on the weight of the bridging agent (A), hydrocarbon oil (B) and organopolysiloxane (C).

21. The process of claim 17, wherein the alcohol is represented by the formula

ROH in which R is a hydrocarbon radical having from 12 to 28 carbon atoms which is selected from the group consisting of branched chain saturated and unsaturated hydrocarbon radicals and unsaturated linear hydrocarbon radicals.

22. The process of claim 17, wherein the organopolysiloxane (C) is a blend of at least two organopolysiloxane fluids having different viscosities.

23. The process of claim 17, wherein the bridging agent is obtained from the reaction of a neutralized hydrolyzate and an alcohol having from 12 to 28 carbon atoms which is selected from the group consisting of branched chain saturated and unsaturated alcohols and unsaturated linear alcohols.

24. Organic fibers treated in accordance with the process of claim 17.

* * * * *